US005282626A

United States Patent [19]

Millar

[11] Patent Number: 5,282,626

[45] Date of Patent: Feb. 1, 1994

[54] GOLF PUTTING PRACTICE DEVICE

[76] Inventor: David G. Millar, 31B Lovelace Road, Surbiton, Surrey KT6 6NA, United Kingdom

[21] Appl. No.: 965,133

[22] Filed: Oct. 22, 1992

[30] Foreign Application Priority Data

Oct. 25, 1991 [GB] United Kingdom ..... 9122692

[51] Int. Cl.[5] ..... A63B 69/36

[52] U.S. Cl. ..... 273/177 R; 273/179 R

[58] Field of Search ..... 273/177 R, 177 A, 177 B, 273/178 R, 179 R, 179 C, 181 K

[56] References Cited

U.S. PATENT DOCUMENTS

| | | | |
|---|---|---|---|
| 1,960,110 | 5/1934 | Iles | 273/162 E |
| 3,065,971 | 11/1962 | Coles | 273/177 B |
| 4,368,888 | 1/1983 | Ren | 273/177 RX |
| 4,886,274 | 12/1989 | Park | 273/177 BX |

*Primary Examiner*—George J. Marlo

*Attorney, Agent, or Firm*—Jenner & Block

[57] ABSTRACT

A golf putting practice device comprises a weight having a generally annular configuration resembling a hole in a putting green in a game of golf and being provided with a planar surface target on a side thereof.

1 Claim, 1 Drawing Sheet

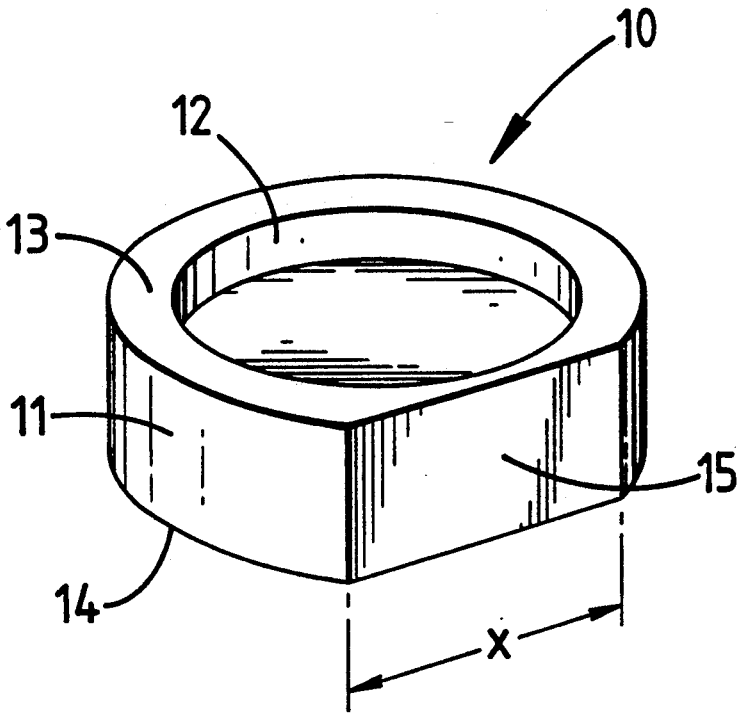
10
12
13
11
15
14
X

GOLF PUTTING PRACTICE DEVICE

This invention relates to a golf putting practice device.

According to the present invention, there is provided a golf putting practice device comprising a weight having a planar surface target and surfaces adjacent the target extending out of the plane of said surface so that, when a ball is directed towards the weight, it will rebound from the weight in a direction substantially the reverse of a direction of the ball towards the weight only if the ball strikes the target.

Following is a description by way of example only and with reference to the accompanying drawing of one method of carrying the invention into effect.

BRIEF DESCRIPTION OF THE DRAWING

The drawing is a perspective view of one embodiment of the golf putting practice device in accordance with the present invention.

Referring to the drawing, there is shown a weight 10 of substantially annular configuration having a curved outer surface 11, a circumferential inner surface 12, a planar upper surface 13 and a planar lower surface 14. The weight 10 may be of gunmetal and the outer surface 11 may be machined to provide a planar surface comprising a rectangular target 15. The target 15 has a horizontal dimension, indicated by "x", which extends parallel to a diameter of the circumferential inner surface 12 and corresponds substantially with a diameter of a hole (not shown) of a putting green of a golf course.

In use, the weight 10 is located on a practice surface, such as the exposed surface of an indoor carpet, with the lower planar surface 14 of the weight 10 in contact with the practice surface. A golf ball (not shown) is then placed on the practice surface at a location spaced from the target 15 and the ball is struck by a golf club (not shown) so that the ball is directed towards the target 15.

The arrangement is such that, if the ball contacts the target 15, the ball will rebound from the surface of the target 15 in a direction substantially the reverse of the direction of the ball towards the weight 10. If, however, the ball strikes the outer surface 11 of the weight 10 outside the boundary of the target 15, the ball will not rebound from the weight 10 in a direction substantially the reverse of the direction of the ball towards the weight 10. In consequence, if a player accurately strikes the ball with the club so that the ball engages the target 15, the ball will rebound from the target 15 towards the player in a direction substantially the reverse of the direction of the ball towards the weight 10 and the player will be in a position to repeat the stroke. With practice, repetitive putting strokes can be carried out at a rate which settles into a rhythm and develops in the player a technique for carrying out successful putting when playing golf.

It will be appreciated that the weight 10 will be of sufficient specific gravity to ensure that it will not be moved from a selected location when struck by the ball during normal use of the weight 10.

It will also be appreciated that the weight 10 may be formed of material other than gunmetal and the material may be highly polished in order to provide an attractive appearance.

Furthermore, it will also be appreciated that the circumferential inner surface 12 may comprise a recess or a bore in the weight 10 and the diameter of the circumferential inner surface 12 may be such as to accommodate a ball which may be used in association with the weight 10 for carrying out golf putting practice.

It will also be appreciated that the weight 10 need not be of annular configuration and need not be provided with a central aperture.

I claim:

1. A golf putting practice device resembling a putting hole comprising a weight having a planar lower surface, an annular upper surface and an outer periphery consisting of a curved outer surface and a rectangularly shaped planar target surface, the weight of said device being such that while supported only on its planar lower surface, golf balls impacting said target surface will rebound therefrom.

* * * * *